US010109922B2

(12) United States Patent
Liu

(10) Patent No.: US 10,109,922 B2
(45) Date of Patent: Oct. 23, 2018

(54) CAPACITIVE-FED MONOPOLE ANTENNA

(71) Applicant: Microsoft Technology Licensing, LLC, Redmond, WA (US)

(72) Inventor: Luyi Liu, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 201 days.

(21) Appl. No.: 14/870,485

(22) Filed: Sep. 30, 2015

(65) Prior Publication Data

US 2017/0093044 A1 Mar. 30, 2017

(51) Int. Cl.

| | |
|---|---|
| ***H01Q 9/04*** | (2006.01) |
| ***H01Q 1/22*** | (2006.01) |
| ***H01Q 1/24*** | (2006.01) |
| ***H01Q 9/40*** | (2006.01) |
| ***H01Q 5/357*** | (2015.01) |
| ***H01Q 5/378*** | (2015.01) |

(52) U.S. Cl.

CPC ..... *H01Q 9/0457* (2013.01); *H01Q 1/2266* (2013.01); *H01Q 1/245* (2013.01); *H01Q 5/357* (2015.01); *H01Q 5/378* (2015.01); *H01Q 9/0414* (2013.01); *H01Q 9/0485* (2013.01); *H01Q 9/40* (2013.01)

(58) Field of Classification Search

CPC .... H01Q 9/0457; H01Q 5/378; H01Q 1/2266; H01Q 1/245; H01Q 9/0485; H01Q 9/40

USPC ..... 343/700 MS

See application file for complete search history.

(56) References Cited

U.S. PATENT DOCUMENTS

| | | | | |
|---|---|---|---|---|
| 5,410,323 | A * | 4/1995 | Kuroda | H01Q 9/0428 343/700 MS |
| 6,876,329 | B2 | 4/2005 | Milosavljevic | |
| 7,079,079 | B2 * | 7/2006 | Jo | H01Q 1/243 343/700 MS |
| 9,865,928 | B2 * | 1/2018 | Sudo | H01Q 9/045 |
| 2006/0044191 | A1 * | 3/2006 | Harihara | H01Q 1/2283 343/700 MS |

(Continued)

FOREIGN PATENT DOCUMENTS

| | | |
|---|---|---|
| CN | 2862358 Y | 1/2007 |
| CN | 2874799 Y | 2/2007 |

(Continued)

OTHER PUBLICATIONS

"International Search Report and Written Opinion Issued in PCT Application No. PCT/US2016/051560", dated Nov. 28, 2016, 12 Pages.

(Continued)

*Primary Examiner* — Dameon E Levi
*Assistant Examiner* — Hasan Islam
(74) *Attorney, Agent, or Firm* — Holzer Patel Drennan

(57) ABSTRACT

A monopole antenna structure disclosed herein includes a ceramic block with a metallic surface coupled to a feed structure and a planar radiation element electrically floating relative to the ceramic block. The planar radiation element is in a parallel plane alignment with the metallic surface of the ceramic block. When the feed structure provides signal of one or more select frequencies to the metallic surface of the ceramic block, the ceramic block radiates (e.g., transmits a carrier wave) and in turn, excites the planar radiation element to re-radiate the signal.

17 Claims, 6 Drawing Sheets

(56) References Cited

U.S. PATENT DOCUMENTS

| | | | | |
|---|---|---|---|---|
| 2007/0120740 | A1 | 5/2007 | Iellici et al. | |
| 2008/0309578 | A1 | 12/2008 | Son et al. | |
| 2009/0146906 | A1* | 6/2009 | Anguera Pros | H01Q 5/371 343/906 |
| 2010/0315303 | A1 | 12/2010 | Kearney et al. | |
| 2010/0321250 | A1 | 12/2010 | Sorvala et al. | |
| 2013/0044039 | A1 | 2/2013 | Wu | |
| 2014/0347225 | A1* | 11/2014 | Harper | H01Q 5/328 343/702 |
| 2014/0347226 | A1 | 11/2014 | Iellici et al. | |
| 2016/0172761 | A1* | 6/2016 | Garcia | H01Q 21/28 343/700 MS |

FOREIGN PATENT DOCUMENTS

| | | | |
|---|---|---|---|
| CN | 101465466 | B | 8/2012 |
| CN | 102738579 | A | 10/2012 |
| CN | 104577311 | A | 4/2015 |
| WO | 2008045151 | A1 | 4/2008 |
| WO | 2011092499 | A1 | 8/2011 |

OTHER PUBLICATIONS

Ammann, et al., "Surface-Mounted UWB Handset Antenna with Small Envelope Volume", In Proceedings of the 5th European Conference on Antennas and Propagation, Apr. 11, 2011, pp. 2475-2477.

"Second Written Opinion Issued in PCT Application No. PCT/US2016/051560", dated Aug. 31, 2017, 5 Pages.

"International Preliminary Report on Patentability Issued in PCT Application No. PCT/US2016/051560", dated Nov. 28, 2017, 9 Pages.

* cited by examiner

CAPACITIVE-FED MONOPOLE ANTENNA

BRIEF DESCRIPTIONS OF THE DRAWINGS

DETAILED DESCRIPTIONS

In some jurisdictions, government agencies impose specific absorption rate (SAR) standards that impose maximum energy absorption limits on electronic device manufacturers. These standards impose restrictions on the amount of electromagnetic radiation that may be emitted at any particular point within a given distance of a transmitting radio frequency (RF) antenna. Such restrictions may be satisfied by reducing transmitted carrier signal strength when a dielectric body (e.g., a human body part) is detected in the proximity of a transmitting antenna.

Since a human hand may contact a variety of a surfaces when holding an electronic device, antennas that generate strong omnidirectional radiation are more likely to trigger potential SAR standard violations than antennas that generate strong unidirectional radiation (e.g., forward-direction radiation). Space and design constraints in increasingly small electronics present a number of challenges to developing suitable antennas.

Figure 1:
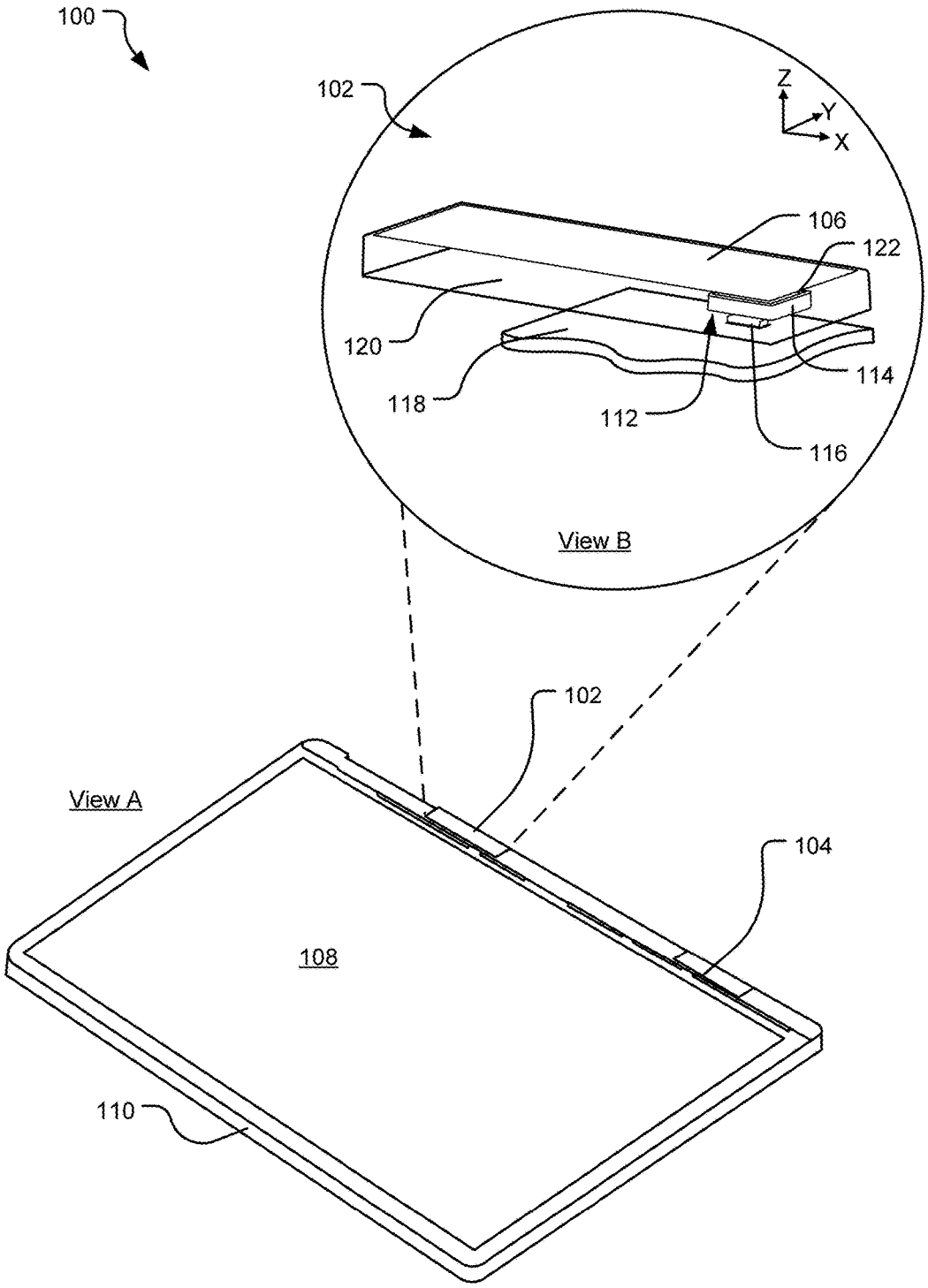
FIG. 1 illustrates a computing device case that includes example capacitive-fed monopole antennas.

FIG. 1 illustrates an example computing device case 100 that includes one or more capacitive-fed monopole antennas (e.g., monopole antennas 102, 104) capable of generating strong forward-direction radiation. The computing device case 100 may be, without limitation, a casing of a tablet computer, laptop, mobile phone, personal data assistant, cell phone, smart phone, Blu-Ray player, gaming system, or any other device including wireless communications circuitry for transmission a radio-frequency carrier wave.

Although some computing devices may include a single monopole antenna, use of two or more monopole antennas in different positions, as shown by monopole antennas 102, 104 in View A, provides the computing device 100 with an increased data transferring rate by applying a MIMO wireless system.

The monopole antennas 102, 104 each radiate through a planar external surface of the computing device 100, such as through a display 108, back face (not shown), or side face 110, depending on device configuration.

Referring to expanded View B, the monopole antenna 102 includes a planar radiation element 106 mounted on an antenna carrier 120, a ceramic structure 114, and a signal feed 116 electrically coupled to a printed circuit board assembly (PCBA) 118. When the signal feed 116 provides a signal of one or more select frequencies to a metallic surface 112 of the ceramic structure 114, the ceramic structure 114 radiates (e.g., transmits a carrier wave) and in turn, excites the planar radiation element 106 to re-radiate the signal. Although a variety of components may be suitable for implementing the signal feed 116, the signal feed 116 is, in one implementation, a metal spring contact.

The ceramic structure 114 is shown supported by the antenna carrier 120 and separated from the planar radiation element 106 by a dielectric spacer 122, which may be gas or solid (e.g., plastic, glass, air). The ceramic structure 114 is made from a material of a high dielectric constant that capacitively couples to the planar radiation element 106 and is capable of exciting the planar radiation element 106 across the dielectric spacer 122. Because the planar radiation element 106 is not grounded or otherwise electrically coupled to the ceramic structure 114 or signal feed 116, the planar radiation element 106 is herein described as "electrically floating" relative to the ceramic structure 114.

In various implementations, the planar radiation element 106 may take on a variety of shapes and sizes, and may be constructed from a variety of suitable metallic materials including, for example, one or more flexible printed circuits (FPC), materials formed by laser direct structuring (LDS) material, or other manufactured metals. The ceramic structure 114 is shown as a cuboid, but may take on other three dimensional configurations in different implementations.

In general, the planar radiation element 106 is oriented with planar surfaces substantially parallel to a planar external surface of the computing device 100. Although other configurations may also be suitable, the planar radiation element 106 is oriented with a planar surface in a plane substantially parallel to a plane including the metallic surface 112. This orientation is herein referred to as a "parallel plane alignment." The particular parallel plane alignment illustrated between the metallic surface 112 and the planar radiation element 106 can also be described by the term "overlap alignment." As used herein, two surfaces are in an "overlap alignment" when an axis normal to at least one of the surfaces intersects both of the surfaces. An overlap alignment may be a partial overlap alignment (e.g., if a part of a surface is in overlap alignment and a part is not in overlap alignment); a full overlap alignment (e.g., if an entire surface is in overlap alignment with another surface); or an edge-to-edge overlap alignment (e.g., when edges of two surfaces in parallel plane alignment are in an overlap alignment with one another).

In some implementations, the planar radiation element 106 includes a notch or cutout (not shown) that is in an overlap alignment with the ceramic structure 114. For example, the ceramic structure 114 may be visible through the notch. The metallic surface 112 may assume a variety of positions while in the parallel plane alignment with the planar radiation element 106 and notch (if a notch exists) to alter resonance statistics in one or multiple frequency bands of the monopole antenna 102.

Offsets between and relative positioning of the ceramic structure 114 and the planar radiation element 106 may vary; however, the monopole antenna 1-2 may radiate at higher in implementations where a center or an edge of the ceramic structure 114 is oriented closer to an edge of the planar radiation element 106. This result is explored in detail with respect to the following figures.

In some implementations, the monopole antenna 102 is configured to transmit electromagnetic radiation in at least two frequency bands. For example, radiation in a first lower frequency band may be attributable, in part, to an edge current of the metallic surface 112 that transfers a surface current to the edge of the planar radiation element 106. In one implementation, the planar radiation element 106 also radiates in a second higher frequency band due to total flux of energy continuously transferred to the main radiation pattern (e.g., energy due to resonance of the standing wave pattern in the ceramic block 114 and the metallic surface 112 of the ceramic block 114 in combination with the transferred edge current).

Example suitable configurations and corresponding resonance statistics are explored in greater detail with respect to FIGS. 2-5.

Figure 2A:
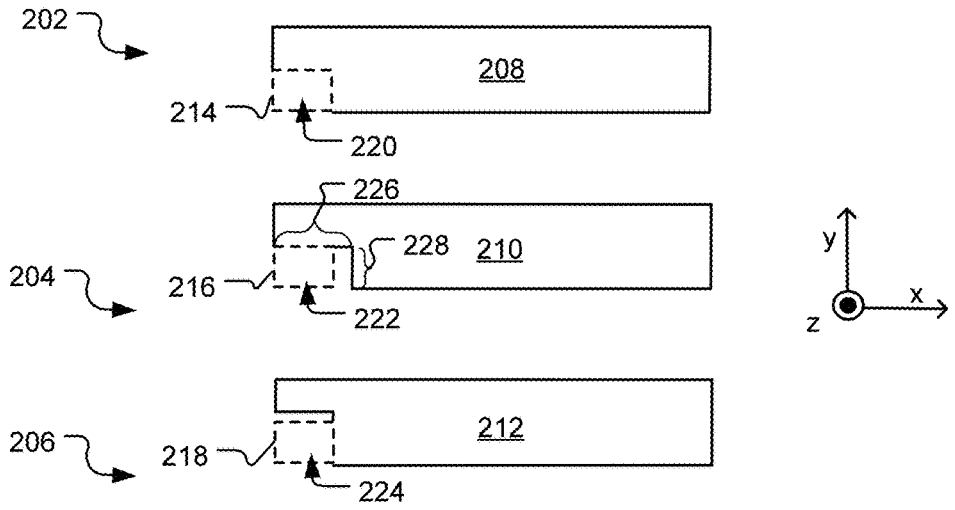
FIG. 2A illustrates top down views of example capacitive-fed monopole antennas.

FIG. 2A illustrates top down views of example different capacitive-fed monopole antennas 202, 204, and 206 that generate strong radiation in a primary direction (e.g., z-direction, out of the page). Each of the capacitive-fed monopole antennas 202, 204, and 206 includes a planar radiation element (planar radiation elements 208, 210, and 212) that is electrically floating relative to an underlying ceramic block (e.g., ceramic blocks 214, 216, and 218). The ceramic blocks 214, 216, and 218 are identical and each include a metallic surface oriented to face away from the corresponding planar radiation element 208, 210, or 212. The metallic surface of each of the ceramic blocks 214, 216, and 218 is in a parallel plane alignment with the corresponding planar radiation element 208, 210, or 212. These metallic surfaces each attach to respective signal feeds that provide RF signal to excite the ceramic blocks 214, 216, and 218 and, in turn, resonate the corresponding planar radiation element 208, 210, and 212 at select frequencies.

The planar radiation elements 202, 204, and 206 each include generally rectangular corner notches (e.g., notches 220, 222, and 224) of variable size. Each of the notches 220, 222, and 224 has a long axis (e.g., a long axis 226 illustrated in an x-direction) and short axis (e.g., a short axis 228 illustrated in a y-direction). The long axes of the notches 220 and 224 are identical to one another in length and shorter in length than the long axis of the notch 222. The short axes of the notches 220 and 222 are identical to one another in length and shorter in length than the short axis of the notch 224.

Figure 2B:
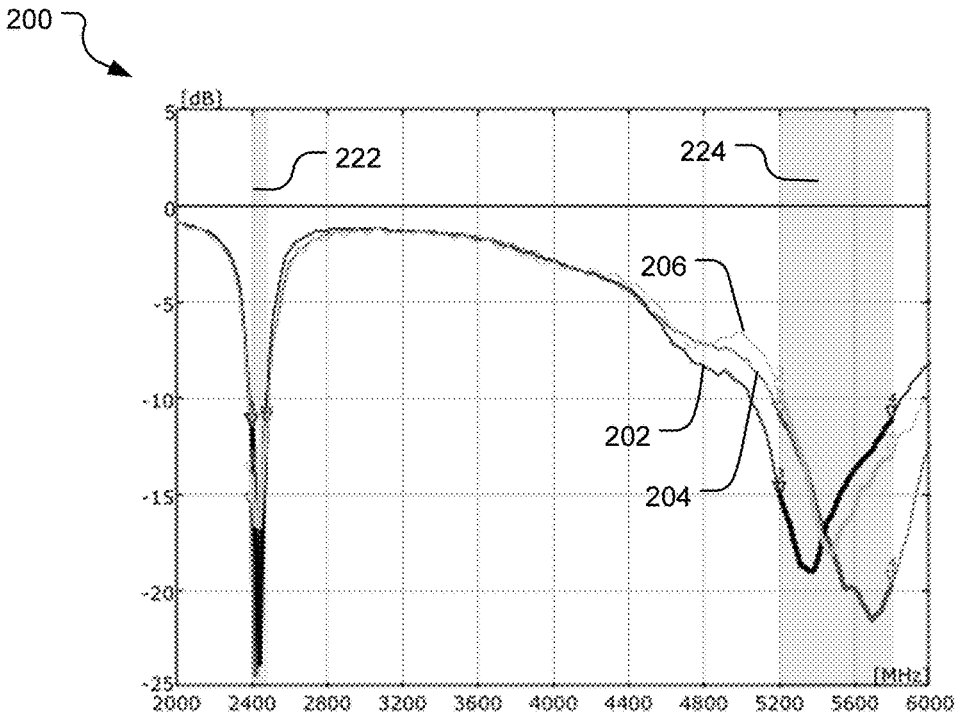
FIG. 2B illustrates a plot showing resonant statistics for each of the capacitive-fed monopole antennas of FIG. 2A.

FIG. 2B illustrates a plot 200 showing resonant statistics for each of the capacitive-fed monopole antennas 202, 204, and 206 when provided with signals varying in frequency between 2000 and 6000 MHz The plot 200 further indicates a first target resonance band 222 centered around 2500 MHz and a second target resonance band 224 centered around 5400 MHz Each of the capacitive-fed monopole antennas 202, 204, and 204 resonates in the first target resonance band 222 and also within the second target resonance band 224. In both the first target resonance band 222 and the second target resonance band 224, all three of the capacitive-fed monopole antennas 202, 204, and 206 are able to provide strong radiation with similar performance.

Figure 3A:
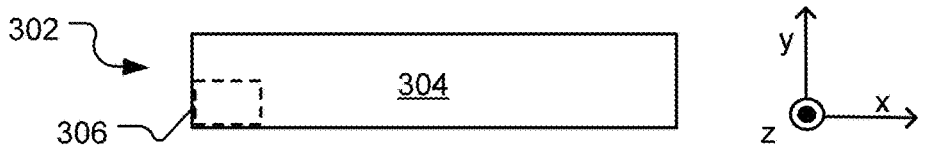
FIG. 3A illustrates a top down view of another example capacitive-fed monopole antenna.

FIG. 3A illustrates a top down view of another example capacitive-fed monopole antenna 302 that generates strong radiation in a primary direction (e.g., z-direction). The capacitive-fed monopole antenna 302 includes a planar radiation element 304 that is electrically floating relative to an underlying ceramic block 306. The ceramic block 306 includes a metallic surface (not shown) facing away from the planar radiation element 304, and the metallic surface of the ceramic block 306 is in a complete overlap alignment with the planar radiation element 304. A signal feed (not shown) feeds a signal to the metallic surface to resonate the ceramic block 306 and, in turn, resonate the planar radiation element 304 at one or more select frequencies.

Unlike the planar radiation elements of FIG. 2A, the planar radiation element 304 does not include a notched corner portion. Rather, the metallic surface of the ceramic block 306 is in full overlap alignment with the planar radiation element 304.

Figure 3B:
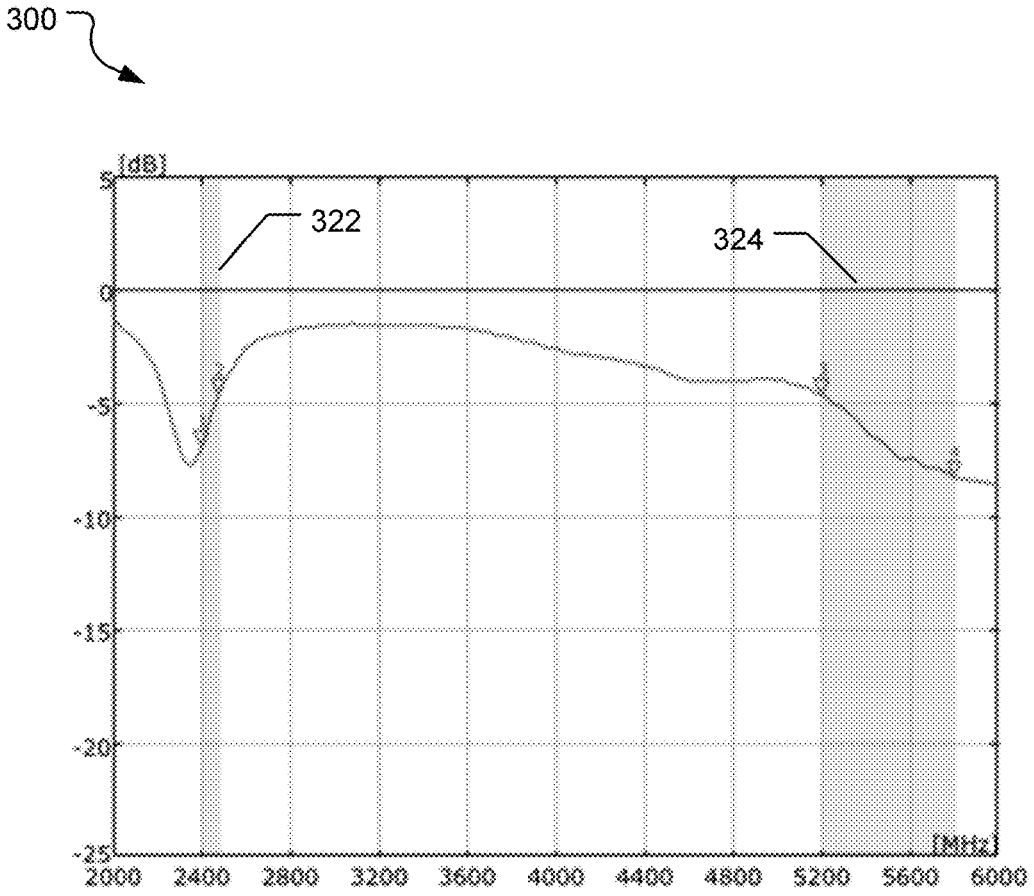
FIG. 3B illustrates a plot showing resonant statistics for the capacitive-fed monopole antenna of FIG. 3A.

FIG. 3B illustrates a plot 300 showing resonant statistics for the capacitive-fed monopole antenna 302 when the antenna is provided with signals varying in frequency between 2000 and 6000 MHz The plot 300 further indicates a first target resonance band 322 centered around 2500 MHz and a second target resonance band 324 centered around 5400 MHz. As demonstrated by the plot 300, the capacitive-fed monopole antenna 302 exhibits weak intensity resonance within the first target resonance band 322 and does not exhibit any detectable resonance within the second target resonance band 324.

The weak resonance in the first frequency band is due to a strong current along the top and right edge of the ceramic block 306 being covered by the planar radiation element 304. Further, the ceramic block 306 contributes a large portion of radiation at the second target resonance band 324. When the top and right edge of the ceramic block 306 is covered by the planar radiation element, a radiation path from the ceramic block 304 is impeded.

Figure 4A:
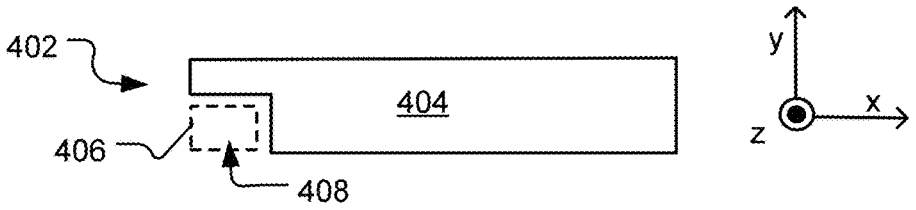
FIG. 4A illustrates a top down view of yet another example capacitive-fed monopole.

FIG. 4A illustrates a top down view of another example capacitive-fed monopole antenna 402 that generates strong radiation in a primary direction (e.g., z-direction). The capacitive-fed monopole antenna 402 includes a planar radiation element 404 that is electrically floating relative to an underlying ceramic block 406. The ceramic block 406 includes a metallic surface (not shown) facing away from the planar radiation element 404, and the metallic surface is in a parallel plane alignment with the planar radiation element 404. A signal feed attaches to the metallic surface. When signal is provided to the ceramic block 406 via the signal feed, the ceramic block 406 resonates and, in turn, resonates the planar radiation element 404 at select frequencies.

The planar radiation element 404 includes a notch 408 formed in a corner portion. The notch 408 has a long axis (shown generally parallel to an x-direction) and a short axis (shown generally parallel to a y-direction). Both the long and short axes of the notch 408 are longer than corresponding axis of the ceramic block 406. Phrased differently, the ceramic block 406 is in full overlap alignment with the notch but not in overlap alignment with the planar radiation element 404.

Figure 4B:
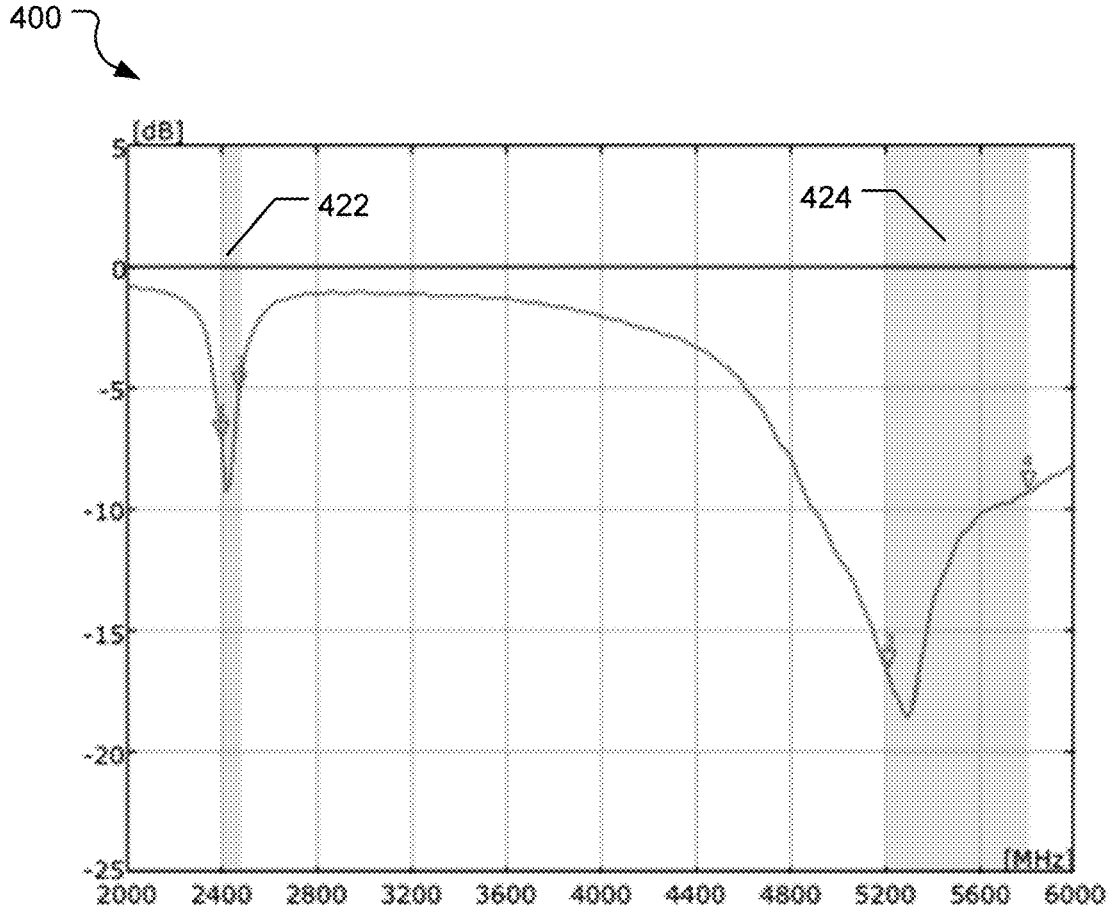
FIG. 4B illustrates a plot showing resonant statistics for the capacitive-fed monopole antenna of FIG. 4A.

FIG. 4B illustrates a plot 400 showing resonant statistics for the capacitive-fed monopole antenna 402 when the capacitive-fed monopole antenna 402 is provided with signals varying in frequency between 2000 and 6000 MHz The plot 400 further indicates a first target resonance band 422 centered around 2500 MHz and a second target resonance band 424 centered around 5400 MHz. The capacitive-fed monopole antenna 402 exhibits resonance within both the first target resonance band 422 and within the second target resonance band 424. However, an intensity of resulting radiation due to resonance in the first target resonance band is considerably weaker than the intensity of radiation due to resonance in the second target resonance band. This effect is due to the ceramic block 406 being too far away from the planar radiation element for the current at the lower frequency to significantly excite a radiation current on an edge of the planar radiation element 404. The intensity of radiation at second target resonance 424 is stronger because the ceramic block is responsible for a large portion of the radiation at the second target resonance 424.

Figure 5A:
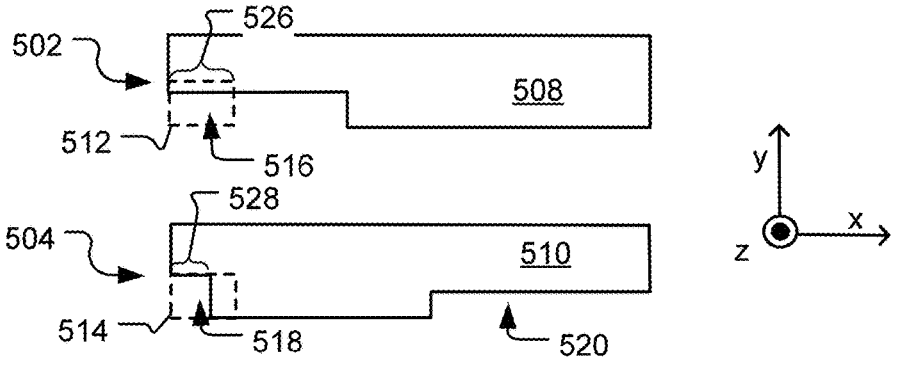
FIG. 5A illustrates top down views of two additional example capacitive-fed monopole antennas.

FIG. 5A illustrates top down views of still further example capacitive-fed monopole antennas 502 and 504 that generate strong radiation in a primary direction (e.g., z-direction). Each of the capacitive-fed monopole antennas 502 and 504 includes a radiation element (planar radiation elements 508 and 510, respectively) electrically floating relative to an underlying ceramic block (e.g., ceramic blocks 512 and 514). The ceramic blocks 512 and 514 are each identical and include metallic surfaces oriented facing away from and in partial overlap alignment with the corresponding planar radiation element 508 or 510.

These metallic surfaces each attach to respective signal feeds that provide RF signal to excite the ceramic blocks 512 and 514 and resonate the corresponding planar radiation elements 508 and 510 at select frequencies.

The planar radiation elements 508 and 510 each include generally rectangular corner notches (e.g., notches 516 and 518) of variable size. The notch 516 is significantly more elongated (e.g., in the x-direction) than the notch 518, while the notch 516 is slightly shallower in the y-direction than the notch 518. In addition, the monopole antenna 518 includes a second notch 520 separated from the ceramic block 514 by a solid portion of the planar radiation element 510. Second notch 520 is for adjusting the electrical length of the resonance. However, the electrical length of the resonance can also be adjusted by modifying the length of either radiation element 508 and 510 (e.g., in the x direction).

Figure 5B:
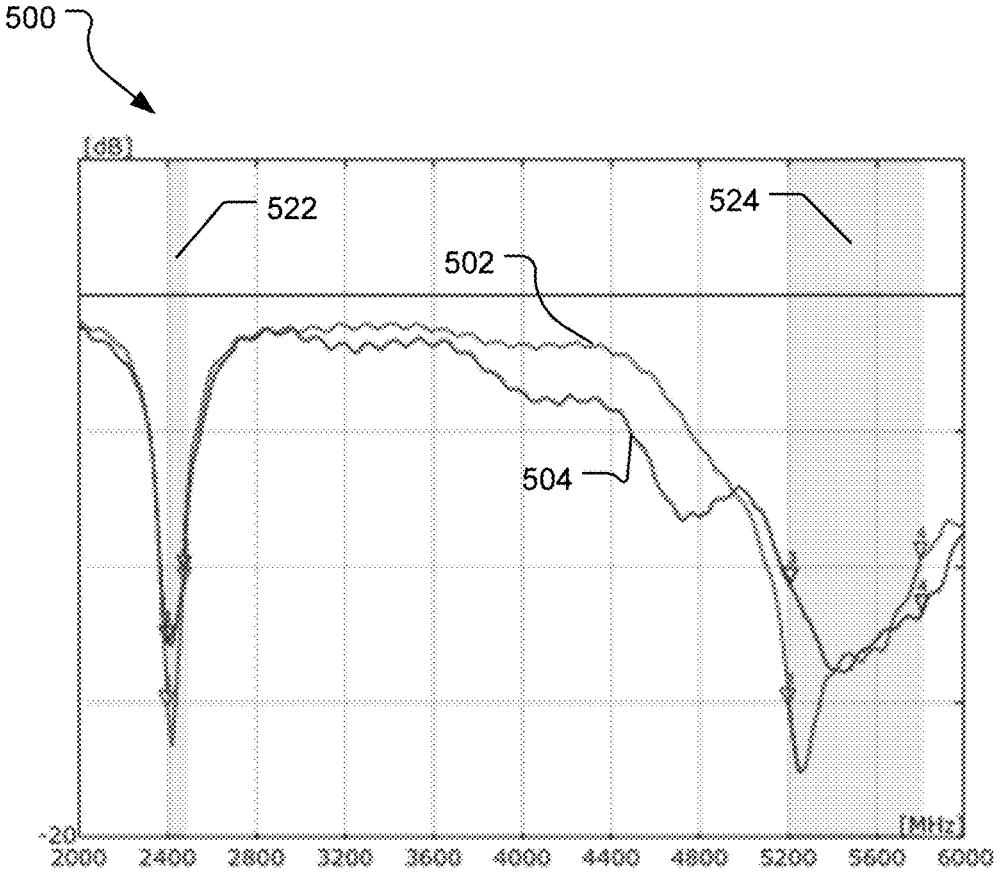
FIG. 5B illustrates a plot showing resonant statistics for the capacitive-fed monopole antennas of FIG. 5A.

FIG. 5B illustrates a plot 500 showing resonant statistics for each of the capacitive-fed monopole antennas 502 and 504 when provided with signals varying in frequency between 2000 and 6000 MHz The plot 500 further indicates a first target resonance band 522 centered around 2500 MHz and a second target resonance band 524 centered around 5400 MHz. Each of the capacitive-fed monopole antennas 502 and 504 exhibits resonance within the first target resonance band 522 and also resonance within the second target resonance band 524.

It should be understood that the capacitive-fed monopole antennas described and illustrated herein are exemplary of a wide array implementations utilizing the disclosed technology. Planar radiation elements of some monopole antennas may include several notches in lieu of the single notch implementations of FIGS. 2A, 4A, and 5A. Other cut-out, notch, and feed structure configurations can result in different antenna resonance bands that may correspond with frequencies used in any radio standard or protocol including without limitation UMTS, GSM, LTE, 4G, 3G, 3G, WiFi, WiMAX, Bluetooth, Miracast, and other standards or specifications that may be developed in the figure.

Figure 6:
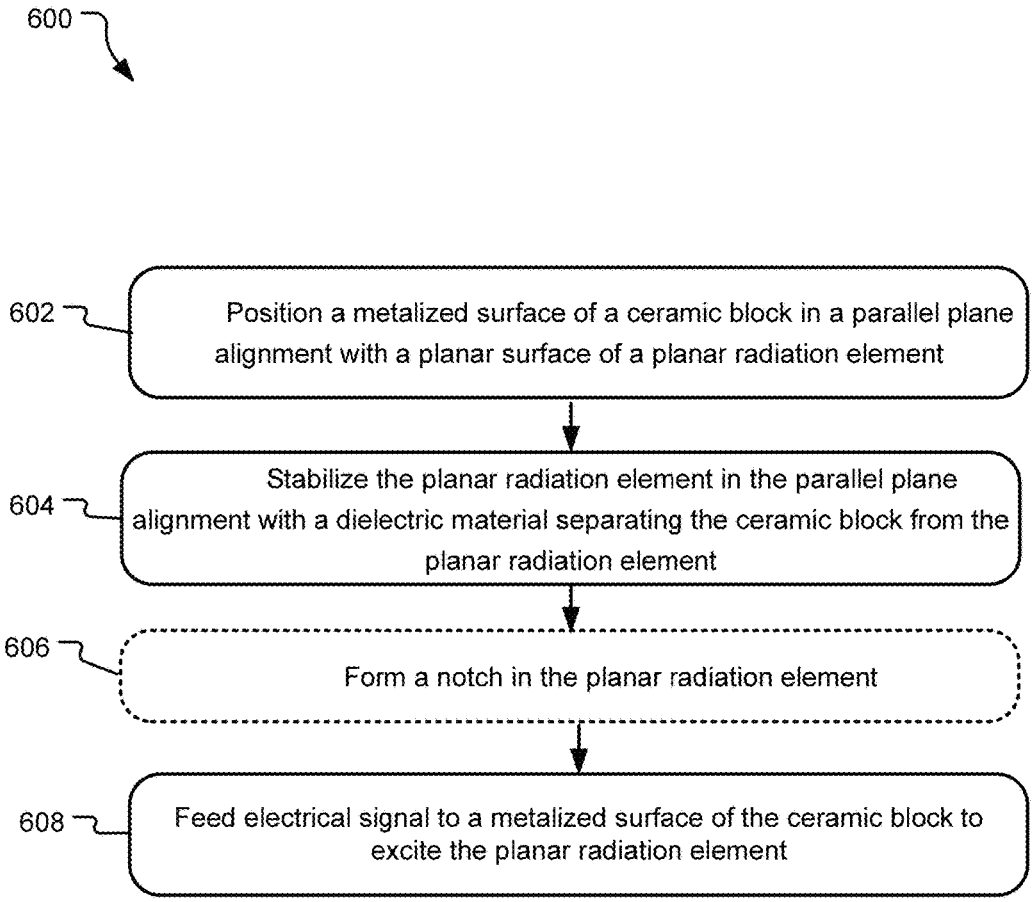
FIG. 6 illustrates example operations for using a capacitive-fed monopole antenna that generates strong forward-direction radiation.

FIG. 6 illustrates example operations 600 for resonating a capacitive-fed monopole antenna at one or more frequencies. A positioning operation 602 positions a ceramic block relative to a planar radiation element such that a metallic surface of the ceramic block is in a parallel plane alignment with a planar surface of the planar radiation element. In one implementation, the metallic surface of the ceramic block faces away from the planar radiation element. A stabilization operation 604 stabilizes the planar radiation element in the parallel plane alignment with a dielectric material separating the ceramic block from the planar radiation element. For example, the stabilization operation 604 may attach the planar radiation element and ceramic block to an antenna carrier with an air gap or other dielectric filling a space between the planar radiation element and ceramic block. Consequently, ceramic block electrically floats relative to the planar radiation element and capacitively couples to the planar radiation element when the metallic surface is provided with an electrical signal.

In some implementations, a forming operation 606 forms a notch 606 in a corner portion of the planar radiation element such that the notch is in an overlap alignment with a portion of the ceramic block.

A signal feeding operation 604 feeds electrical signal to a metallic surface of the ceramic block to excite the planar radiation element. For example, the metallic surface of the ceramic block is opposite a non-metallic surface facing the planar radiation element. If the electrical signal assumes one or more select frequencies of resonance, the ceramic block resonates, exciting the planar radiation element to re-radiate the electrical signal.

In various implementations, the ceramic block and the planar radiation element assume different positions relative to one other while maintaining a parallel plane alignment. In one implementation one or more edges of the ceramic block and planar radiation element are in edge-to-edge overlap alignment.

In another implementation, the metallic surface of the ceramic block is in a partial overlap alignment with the planar radiation element. For example, a first portion of the metallic surface is in overlap alignment with the planar radiation element and a second portion of the metallic surface is in not in overlap alignment with the planar radiation element.

In another implementation, the planar radiation element includes a rectangular notch and the ceramic block is positioned in overlap alignment with the notch (e.g., a full overlap alignment or a partial overlap alignment). In the case of a partial overlap alignment between the ceramic block and the notch, the ceramic block may also exhibit a partial overlap alignment with the planar radiation element.

In yet another implementation, the metallic surface of the ceramic block is in overlap alignment with a notch formed in the planar radiation element but is not in any overlap alignment with the planar radiation element.

One example monopole antenna system includes a ceramic block including a metallic surface coupled to a feed structure and a planar radiation element electrically floating relative to the ceramic block and including a planar surface in a parallel plane alignment with the metallic surface of the ceramic block.

Another example monopole antenna system of any previous example monopole antenna system has the ceramic block in a partial overlap alignment with the planar radiation element.

Another example monopole antenna system of any previous example monopole antenna system includes the planar radiation element with a notch and the ceramic block is in overlap alignment with the notch.

Another example monopole antenna system of any previous example monopole antenna system includes a configuration in which the ceramic block and the planar radiation element each include one or more edges arranged in an edge-to-edge overlap alignment.

Another example monopole antenna system of any previous example monopole antenna system includes a configuration in which the ceramic block and the planar radiation element each include two edges arranged in an edge-to-edge overlap alignment.

Another example monopole antenna system of any previous example monopole antenna system includes a configuration in which the metallic surface of the ceramic block is fed by an antenna spring contact.

Another example monopole antenna system of any previous example monopole antenna system includes a configuration in which the planar radiation element is configured to resonate at multiple frequencies.

Another example monopole antenna system of any previous example monopole antenna system includes a configuration in which the planar radiation element is not electrically grounded.

An example method includes feeding an electrical signal to a metallic surface of a ceramic block to excite a planar radiation element. The planar radiation element is electrically floating relative to the ceramic block and includes a planar surface in a parallel plane alignment with the metallic surface of the ceramic block.

Another example method of any previous example method includes a feeding operation that includes exciting the planar radiation element to radiate at a first frequency and exciting the planar radiation element to radiate at a second frequency.

Another example method of any previous example method excites the planar radiation element, wherein the planar radiation element includes a notch and a portion of the ceramic block is in overlap alignment with the notch.

Another example method of any previous example method excites the planar radiation element, wherein a notch is formed in a corner of the planar radiation element.

Another example method of any previous example method excites the planar radiation element, wherein the ceramic block in an edge-to-edge overlap alignment with the planar radiation element.

Another example method of any previous example method excites the planar radiation element, wherein the ceramic block is in a partial overlap alignment with the planar radiation element.

Another example method of any previous example method excites the planar radiation element, wherein the ceramic block is defined by a long axis and a short axis and the ceramic block is in overlap alignment with the planar radiation element along the long axis.

An example system includes a signal feed coupled to a metallic surface of a ceramic block and a planar radiation element electrically floating relative to the ceramic block and including a notch formed in a corner portion that is in overlap alignment with a portion of the ceramic block.

Another example system of any previous example system includes the ceramic block and the planar radiation element wherein an overlap alignment is a partial overlap alignment.

Another example system of any previous example system includes the ceramic block and the planar radiation element wherein an overlap alignment is an edge-to-edge overlap alignment.

Another example system of any previous example system includes the ceramic block and the planar radiation element wherein the ceramic block capacitively couples to the planar radiation element across a dielectric spacer.

Another example system of any previous example system includes the ceramic block and the planar radiation element wherein the planar radiation element is configured to resonate at multiple frequencies.

An example system includes means for feeding an electrical signal to a metallic surface of a ceramic block to excite a planar radiation element. The planar radiation element is electrically floating relative to the ceramic block and includes a planar surface in a parallel plane alignment with the metallic surface of the ceramic block.

Another example system of any previous example system includes the means for feeding includes means for exciting the planar radiation element to radiate at a first frequency and means for exciting the planar radiation element to radiate at a second frequency.

Another example system of any previous example system includes the means for exciting the planar radiation element, wherein the planar radiation element includes a notch and a portion of the ceramic block is in overlap alignment with the notch.

Another example system of any previous example system includes the means for exciting the planar radiation element, wherein a notch is formed in a corner of the planar radiation element.

Another example system of any previous example system includes the means for exciting the planar radiation element, wherein the ceramic block in an edge-to-edge overlap alignment with the planar radiation element.

Another example system of any previous example system includes the means for exciting the planar radiation element, wherein the ceramic block is in a partial overlap alignment with the planar radiation element.

Another example system of any previous example system includes the means for exciting the planar radiation element, wherein the ceramic block is defined by a long axis and a short axis and the ceramic block is in overlap alignment with the planar radiation element along the long axis.

The logical operations making up embodiments of the invention described herein are referred to variously as operations or steps. It should be understood that logical operations may be performed in any order, adding and omitting as desired, unless explicitly claimed otherwise or a specific order is inherently necessitated by the claim language.

The above specification, examples, and data provide a complete description of the structure and use of exemplary embodiments of the invention. Since many implementations of the invention can be made without departing from the spirit and scope of the invention, the invention resides in the claims hereinafter appended. Furthermore, structural features of the different embodiments may be combined in yet another implementation without departing from the recited claims.

What is claimed is:

1. A monopole antenna system comprising:

a ceramic block including a metallic surface coupled to a feed structure; and an ungrounded planar radiation element physically separated from the ceramic block and including a planar surface in a parallel plane alignment with the metallic surface of the ceramic block and further including a notch formed in a corner portion that is in overlap alignment with a portion of the ceramic block, wherein the ceramic block capacitively couples to the ungrounded planar radiation element across a dielectric spacer.

2. The monopole antenna system of claim 1, wherein the ceramic block is in a partial overlap alignment with the ungrounded planar radiation element.

3. The monopole antenna system of claim 1, wherein the ceramic block and the ungrounded planar radiation element each include one or more edges arranged in an edge-to-edge overlap alignment.

4. The monopole antenna system of claim 1, wherein the ceramic block and the ungrounded planar radiation element each include two edges arranged in an edge-to-edge overlap alignment.

5. The monopole antenna system of claim 1, wherein the metallic surface of the ceramic block is fed by an antenna spring contact.

6. The monopole antenna system of claim 1, wherein the ungrounded planar radiation element is configured to resonate at multiple frequencies.

7. The monopole antenna of claim 1, wherein the ungrounded planar radiation element is capacitively-driven by the ceramic block.

8. A method comprising:

feeding an electrical signal to a metallic surface of a ceramic block to excite an ungrounded planar radiation element, the ungrounded planar radiation element physically separated from the ceramic block and including a planar surface in a parallel plane alignment with the metallic surface of the ceramic block and further including a notch formed in a corner portion that is in overlap alignment with a portion of the ceramic block, wherein the ceramic block capacitively couples to the ungrounded planar radiation element across a dielectric spacer.

9. The method of claim 8, wherein feeding an electrical signal to a metallic surface of a ceramic block to excite the ungrounded planar radiation element further comprises:

exciting the ungrounded planar radiation element to radiate at a first frequency; and exciting the ungrounded planar radiation element to radiate at a second frequency.

10. The method of claim 8, the ungrounded planar radiation element includes a notch and a portion of the ceramic block is in overlap alignment with the notch.

11. The method of claim 8, wherein the ceramic block is in an edge-to-edge overlap alignment with the ungrounded planar radiation element.

12. The method of claim 8, wherein the ceramic block is in a partial overlap alignment with the ungrounded planar radiation element.

13. The method of claim 8, wherein the ceramic block is defined by a long axis and a short axis and the ceramic block is in overlap alignment with the ungrounded planar radiation element along the long axis.

14. A system comprising:

a signal feed coupled to a metallic surface of a ceramic block; and an ungrounded planar radiation element physically separated from the ceramic block and including a notch formed in a corner portion that is in overlap alignment with a portion of the ceramic block, wherein the ceramic block capacitively couples to the ungrounded planar radiation element across a dielectric spacer.

15. The system of claim 14, wherein the overlap alignment is a partial overlap alignment.

16. The system of claim 14, wherein the overlap alignment is an edge-to-edge overlap alignment.

17. The system of claim 14, wherein the ungrounded planar radiation element is configured to resonate at multiple frequencies.

* * * * *